US010667623B1

(12) United States Patent
Hsiao

(10) Patent No.: US 10,667,623 B1
(45) Date of Patent: Jun. 2, 2020

(54) RESILIENT SUPPORTING STRUCTURE OF CHAIRS

(71) Applicant: Yun-Cheng Hsiao, Tainan (TW)

(72) Inventor: Yun-Cheng Hsiao, Tainan (TW)

( * ) Notice: Subject to any disclaimer, the term of this patent is extended or adjusted under 35 U.S.C. 154(b) by 0 days.

(21) Appl. No.: 16/262,897

(22) Filed: Jan. 30, 2019

(30) Foreign Application Priority Data

Dec. 20, 2018 (TW) ..... 107146142 A

(51) Int. Cl.
*A47C 7/22* (2006.01)
*A47C 31/06* (2006.01)
*A47C 7/40* (2006.01)

(52) U.S. Cl.
CPC ..... *A47C 31/06* (2013.01); *A47C 7/22* (2013.01); *A47C 7/40* (2013.01)

(58) Field of Classification Search
CPC ..... A47C 7/287; A47C 7/28; A47C 31/06; A47C 7/22; A47C 1/03277
See application file for complete search history.

(56) References Cited

U.S. PATENT DOCUMENTS 1,774,696 A * 9/1930 Bernstein ..... A47C 7/22 267/112
1,888,582 A * 11/1932 Bernstein ..... A47C 7/22 267/112
1,899,726 A * 2/1933 Rusnak ..... A47C 7/22 267/99
3,039,763 A * 6/1962 Staples ..... A47C 7/22 267/107
3,094,358 A * 6/1963 Hartman ..... A47C 4/30 297/452.64
3,170,215 A * 2/1965 Hopkins ..... A47C 7/22 24/265 C
3,272,497 A * 9/1966 Valdelievre ..... A47C 7/22 267/110

(Continued)

FOREIGN PATENT DOCUMENTS

CH 169640 A * 6/1934 ..... A47C 7/22
EP 3033974 A1 * 6/2016 ..... A47C 3/00

(Continued)

*Primary Examiner* — Timothy J Brindley
(74) *Attorney, Agent, or Firm* — Hershkovitz & Associates, PLLC; Abe Hershkovitz

(57) ABSTRACT

A resilient supporting structure of chairs which is used as a cushion or a back pad on a chair has multiple resilient components and multiple flexible supporting components. The resilient components and the flexible supporting components are woven and interlaced at right angles to form a bearing body. The resilient components are resilient elements which are extendable and compressible. The resilient components offer a resilient support. The flexible supporting components are flexible elements which are non-extendable and non-compressible. The flexible supporting components are woven and interlaced with the resilient components at right angles and generate appropriate and dispersed binding force between the resilient components. Therefore, the flexible supporting components effectively limit the distance between the resilient components while being forced and deforming By this, the resilient supporting structure of chairs maintains the comfortable bearing ability, and avoids being over forced and causing elastic fatigue on the resilient components.

16 Claims, 5 Drawing Sheets

(56) References Cited

U.S. PATENT DOCUMENTS

| | | | | | |
|---|---|---|---|---|---|
| 3,982,737 | A * | 9/1976 | Platt | A47C 7/287 | 267/102 |
| 3,994,482 | A * | 11/1976 | Platt | A47C 7/287 | 267/102 |
| 4,337,931 | A * | 7/1982 | Mundell | A47C 7/287 | 267/102 |
| 5,544,943 | A * | 8/1996 | Durling | A47C 7/22 | 267/103 |
| 6,536,791 | B1 * | 3/2003 | Adams | A47C 7/22 | 280/250.1 |
| 9,560,916 | B1 * | 2/2017 | Bullard | A47C 7/22 | |
| 2008/0238177 | A1 * | 10/2008 | Hsiao | A47C 7/024 | 297/452.63 |
| 2013/0062924 | A1 * | 3/2013 | Caldwell | A47C 31/023 | 297/452.63 |
| 2015/0137576 | A1 * | 5/2015 | Bullard | A47C 7/22 | 297/452.18 |
| 2017/0354259 | A1 * | 12/2017 | Gale | A47C 7/22 | |

FOREIGN PATENT DOCUMENTS

| | | | | | |
|---|---|---|---|---|---|
| FR | 810723 | A * | 3/1937 | A47C 7/22 | |
| FR | 1094637 | A * | 5/1955 | B60N 2/3043 | |
| FR | 1133626 | A * | 3/1957 | A47C 7/287 | |
| WO | WO-2009055252 | A1 * | 4/2009 | A47C 23/002 | |

* cited by examiner

RESILIENT SUPPORTING STRUCTURE OF CHAIRS

BACKGROUND OF THE INVENTION

1. Field of the Invention

The present invention relates to a chair, especially to a resilient supporting structure of chairs.

2. Description of the Prior Arts

Currently, a chair which has a resilient supporting structure generally comprises multiple resilient strips (or resilient belts) which are arranged in parallel and are connected between two rods on two sides of a chair frame. The resilient strips (or resilient belts) which are arranged in parallel offer resilient support so that the chair provides both sitting comfort and ventilation.

In the abovementioned resilient supporting structure, because each one of the resilient strips (or resilient belts) bears the weight of the user independently, the resilient strips (or resilient belts) are not evenly stressed. Moreover, after a long term of bearing the weight of the user, a distance between the parallel-arranged resilient strips (or resilient belts) will increase such that the chair will lose the bearing ability that can comfortably support the user. In addition, after the chair which has a resilient supporting structure is used for a long time, it is prone to elastic fatigue on the abovementioned resilient strips (or resilient belts) and then subject to loosening. Under the abovementioned situation, the bearing ability of the resilient supporting structure is reduced such that the chair can hardly maintain the necessary support for sitting comfort.

Besides, another resilient supporting structure comprises multiple resilient strips (or resilient belts) woven and interlaced with each other at right angles. Two ends of each of the resilient strips (or resilient belts) are fixed on the chair frame of the chair. Because the resilient support comes from both vertical and horizontal resilient strips, the resilient supporting structure eliminates elastic fatigue.

However, the vertical and horizontal resilient strips (or resilient belts) in the aforementioned resilient supporting structure are both resilient elements. Thus, a distance between the vertical resilient strips (or resilient belts) and a distance between the horizontal resilient strips (or resilient belts) will still increase because the weight of the user presses on the resilient strips (or resilient belts) when the user is sitting on the resilient supporting structure. Therefore, the resilient supporting structure still cannot offer a comfortable sitting experience to the user.

Furthermore, two ends of each one of the vertical resilient strips (or resilient belts) and two ends of each one of the horizontal resilient strips (or resilient belts) all need to be fixed to the chair frame of the chair by fixing elements. Thus, this structural configuration of the resilient supporting structure will cause waste of labor as well as time during manufacturing.

To overcome the shortcomings, the present invention provides a resilient supporting structure of chairs to mitigate or obviate the aforementioned problems.

SUMMARY OF THE INVENTION

The main objective of the present invention is to provide a resilient supporting structure of chairs that solves two shortcomings of the conventional resilient supporting structures of chairs. The first shortcoming is that the distance between the resilient strips (or resilient belts) will increase after bearing the weight of the user, thereby making the chair lose the bearing ability that can maintain comfort of a user. The second shortcoming is the waste of time and labor during manufacturing caused by the resilient strips (or resilient belts) which all need to be fixed in both vertical and horizontal directions.

The resilient supporting structure of chairs has multiple resilient components and multiple flexible supporting components. The resilient components are arranged in parallel. Each one of the resilient components comprises a resilient body and two fixing elements. The two fixing elements are mounted on two ends of the resilient body respectively. The flexible supporting components are woven and interlaced with the resilient components at right angles.

The present invention can be mounted on a chair frame of a chair as a cushion or a back pad, and has the following advantages:

1. Limiting the distances between the resilient components and between the flexible supporting components during pressed deformation: The resilient supporting structure in the present invention uses multiple resilient components and multiple flexible supporting components woven and interlaced with each other to form a bearing body. Using resilient components, which are extendable and compressible, as resilient elements, the resilient supporting structure is provided with a resilient bearing ability. On the basis that the resilient supporting structure has a bearing ability for sitting comfort and a ventilation effect, the present invention uses flexible supporting components, which are non-extendable and non-compressible, as flexible elements. The flexible supporting components are woven and interlaced with the resilient components at right angles. Thus, the flexible supporting components generate appropriate and dispersed binding force between the resilient components. Therefore, the flexible supporting components effectively limit the distance between the resilient components while being forced and deforming. By this, the flexible supporting components make sure the resilient supporting structure of chairs in the present invention maintains its bearing ability to maintain sitting comfort.

2. Ease in assembly: In accordance with the above, the resilient supporting structure in the present invention uses multiple resilient components and multiple flexible supporting components woven and interlaced with each other at right angles to form a bearing body. Compared to the conventional resilient supporting structure, the present invention is easier to assemble because the manufacturer only needs to fix two ends of the resilient components to the two rods on the two sides of the chair frame when assembling the present invention instead of fixing two ends of both the vertical and horizontal resilient components to the chair frame.

3. Effective reduction of the over-forced situation and elastic fatigue caused thereby on the resilient components: In accordance with the above, the flexible supporting components in the present invention are mounted through and between the resilient components woven and interlaced with each other at right angles. Thus, the flexible supporting components generate appropriate and dispersed binding force between the resilient components. Therefore, the flexible supporting components avoid the over-forced situation that causes elastic fatigue on any of the resilient components, and then further extend the life of the resilient supporting structure.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
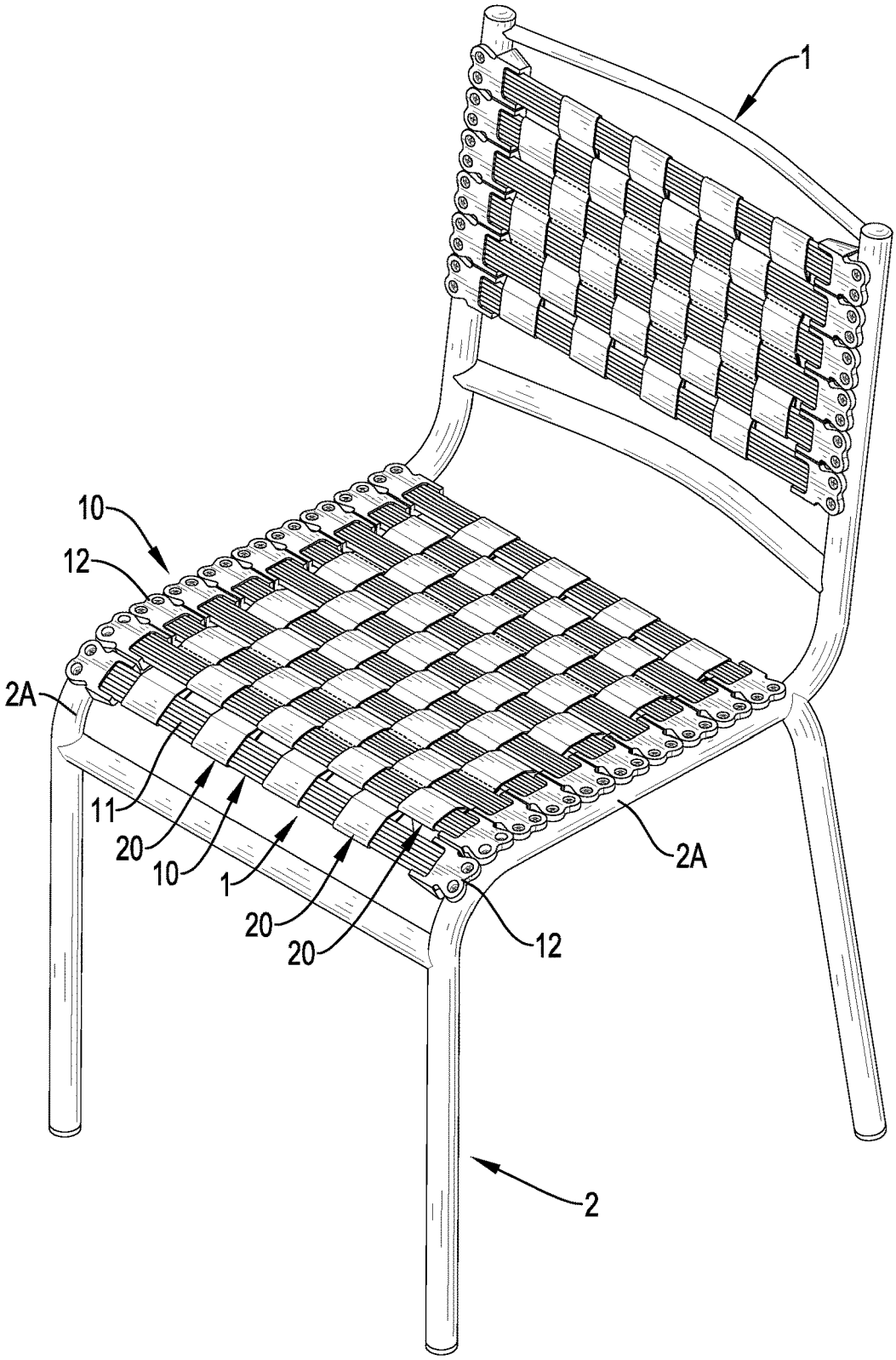
FIG. 1 is a perspective view of a resilient supporting structure of chairs in accordance with the present invention; showing a preferred embodiment used as a cushion and a back pad.
Figure 2:
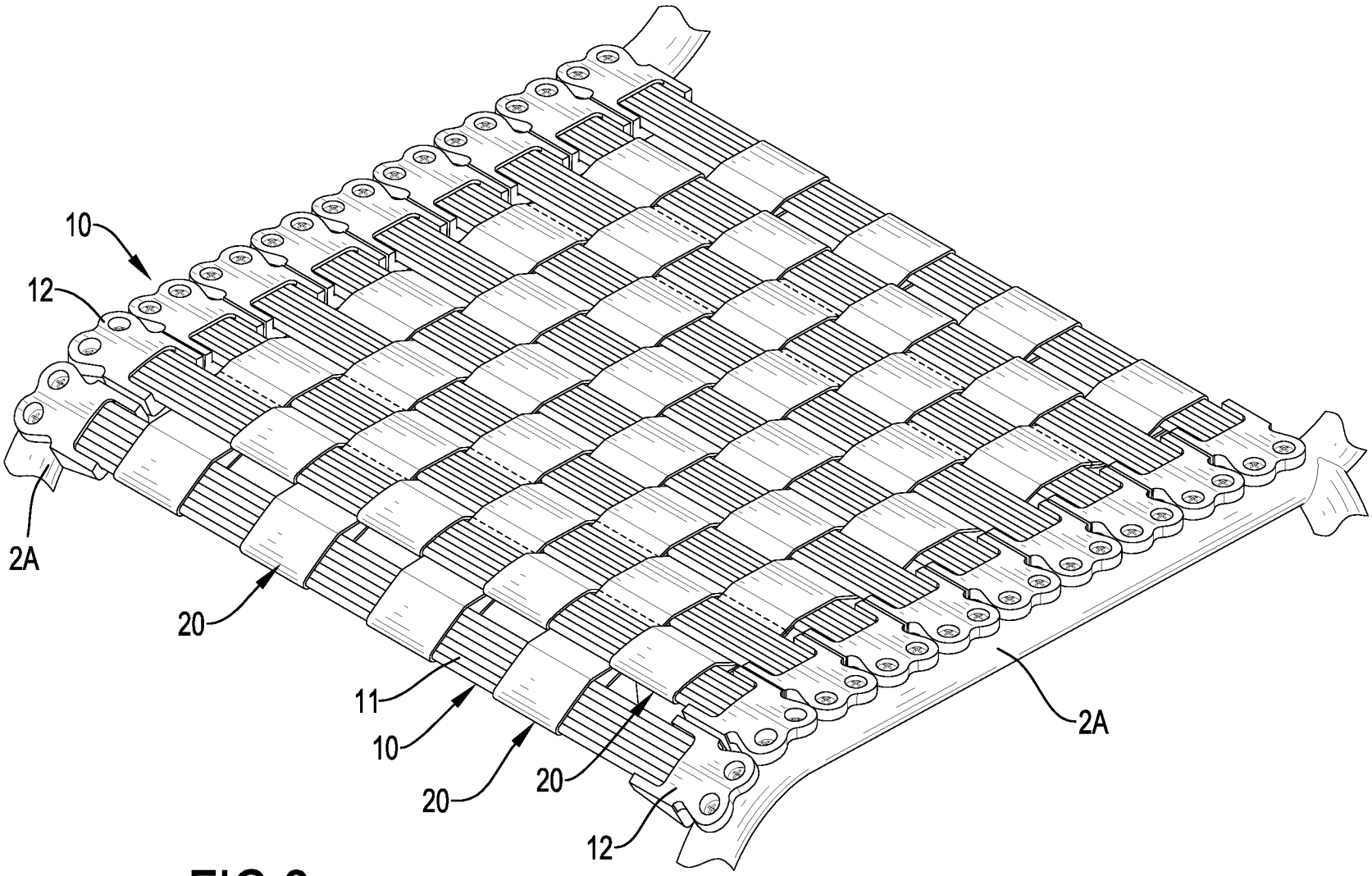
FIG. 2 is a partial enlarged view of the resilient supporting structure of chairs in FIG. 1.
Figure 3:
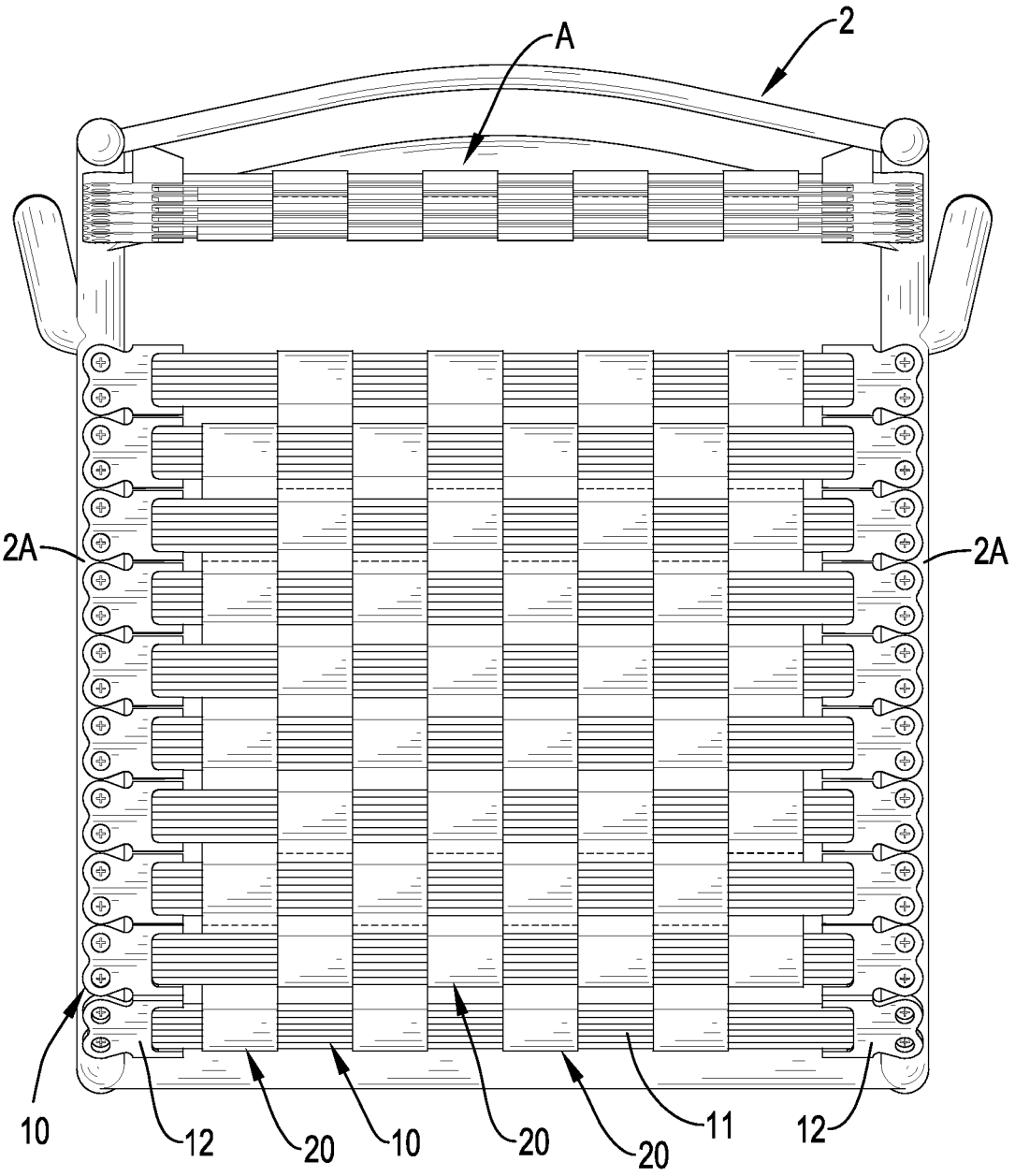
FIG. 3 is a top view of the resilient supporting structure of chairs in FIGS. 1 and 2; showing a preferred embodiment used as a cushion and a back pad.

A resilient supporting structure of chairs in the present invention is mainly used as a cushion or further used as a back pad. With reference to FIGS. 1 to 3, which are reference drawings showing the resilient supporting structure of chairs in the present invention used as a cushion and a back pad, a resilient supporting structure of chairs in accordance with the present invention comprises multiple resilient components 10 and multiple flexible supporting components 20.

With reference to FIGS. 1 to 3, the resilient components 10 are arranged in parallel. Each one of the resilient components 10 comprises a resilient body 11 and two fixing elements 12. The resilient body 11 is a resilient elongated strip and is extendable and compressible. The two fixing elements 12 are mounted on two ends of the resilient body 11 respectively. Each one of the two fixing elements 12 comprises a connecting segment and a fixing segment. The corresponding end of the resilient body 11 is mounted in and connects to an end the connecting segment. The fixing segment is formed on the other end of the connecting segment. The fixing segment comprises one hole or multiple holes.

With reference to FIGS. 1 to 3, each one of the resilient bodies 11 is a one-piece flat resilient belt. Alternatively, with reference to FIGS. 4A, 4B, 5A and 5B, each one of the resilient bodies 11 can also be a flat resilient belt which is formed by multiple resilient strips arranged in parallel and mounted together. The cross-section of the resilient strips can be in a round shape, a polygon, or in any other geometric shape.

With reference to FIGS. 1 to 3, the flexible supporting components 20 are flexible elements which are non-extendable and non-compressible. The supporting components 20 can be flat belts, for example, woven belts. The flexible supporting components 20 are woven and interlaced with the resilient components 10 at right angles.

Figure 4B:
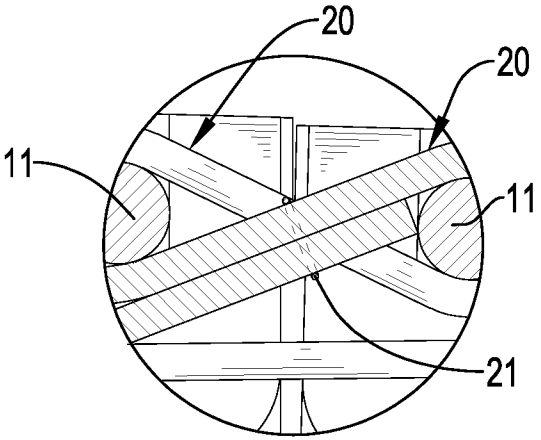
FIG. 4B is a partial enlarged view of FIG. 4A.
Figure 4A:
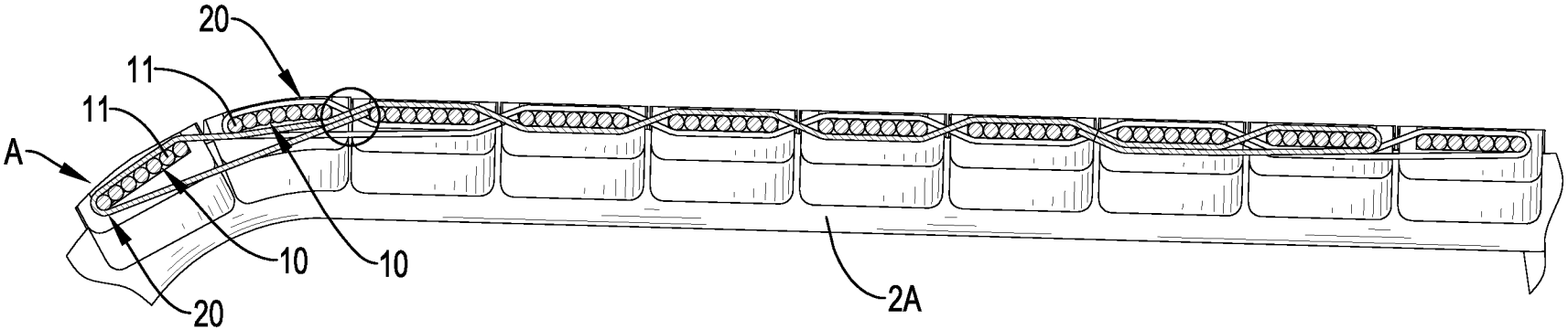
FIG. 4A is a side view in cross-section of the resilient supporting structure of chairs in FIG. 1; showing an end of a flexible supporting component in a preferred embodiment fixed by a sewing thread.
Figure 5B:
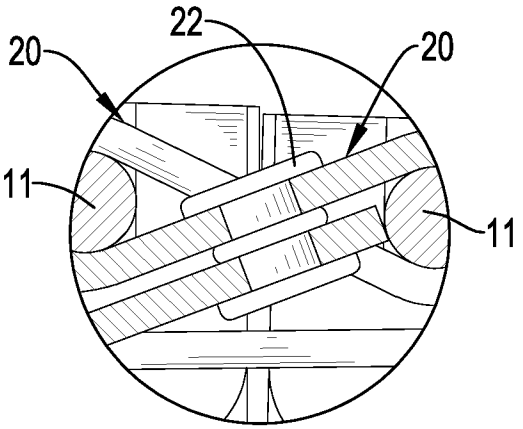
FIG. 5B is a partial enlarged view of FIG. 5A.
Figure 5A:
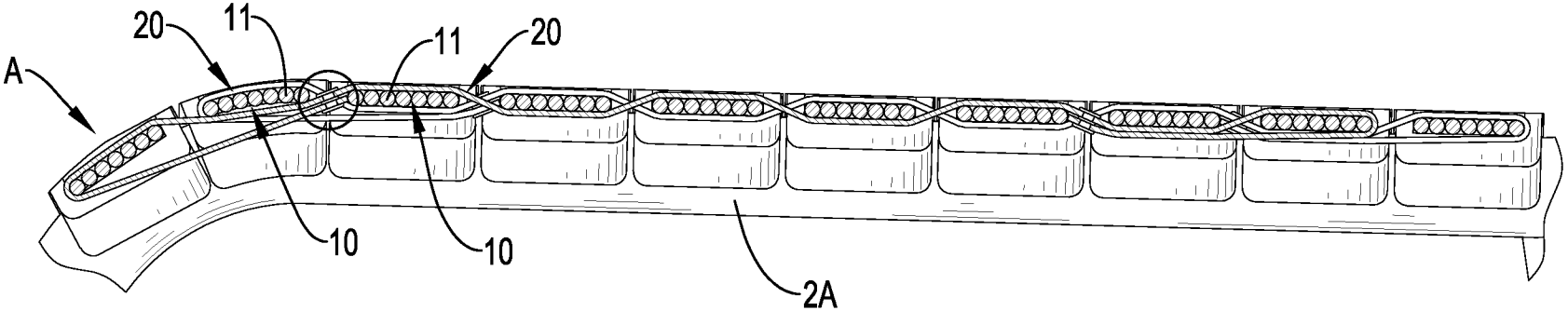
FIG. 5A is a side view in cross-section of the resilient supporting structure of chairs in FIG. 1; showing an end of a flexible supporting component in another preferred embodiment fixed by a riveting element.

In the resilient supporting structure of chairs 1, with reference to FIGS. 4A and 4B, two ends of each flexible supporting component 20 surround two of the resilient components 10 respectively, and are fixed to the flexible supporting component 20. One of the ends of each flexible supporting component 20 is fixed by a sewing thread 21. Alternatively, one of the two ends of each flexible supporting component 20 can also be fixed by a riveting element. Alternatively, with reference to FIGS. 5A and 5B, one of the two ends of each flexible supporting component 20 can also be fixed by a fastener 22. Alternatively, one of the two ends of each flexible supporting component 20 can also be fixed by a hook-and-loop fastener. When the end of each one of the flexible supporting components 20 is fixed by a fastener 22 or hook-and-loop fastener, the flexible supporting components 20 connect to the resilient components 10 detachably and are therefore replaceable.

With reference to FIGS. 1 to 3, when in use, the resilient supporting structure of chairs 1 can be mounted on a chair frame 2 and can be used as a cushion or a back pad. When the resilient supporting structure of chairs 1 is mounted on a chair frame 2, the fixing elements 12 on the two ends of each one of the resilient components 10 are fixed to the rods 2A on the two sides of the chair frame 2 respectively by fixing elements such as screws. The resilient supporting structure of chairs 1 uses the multiple resilient components 10 woven and interlaced with the multiple flexible supporting components 20 at right angles to form a bearing body. The user can sit on or lean on the bearing body.

When used as a cushion or a back pad, the resilient supporting structure of chairs 1 uses the multiple resilient components 10 and the multiple flexible supporting components 20 woven and interlaced with each other at right angles to form a bearing body. Using the resilient components 10, which are extendable and compressible, as resilient element, the resilient supporting structure of chairs 1 is provided with a resilient bearing ability. On the basis that the resilient supporting structure of chairs 1 offers a comfortable sitting experience and ventilation, the present invention uses the flexible supporting components 20, which are non-extendable and non-compressible, as flexible elements. The flexible supporting components 20 are woven and interlaced with the resilient components 10 at right angles. Thus, the flexible supporting components 20 generate appropriate and dispersed binding force between the resilient components 10, and then effectively limit the distance between the resilient components 10 while being forced and deforming. By this, the flexible supporting components 20 make sure the resilient supporting structure of chairs 1 in the present invention maintains the bearing ability for sitting comfort, and also effectively avoid causing elastic fatigue on any of the resilient components 10, and then further extend the life of the resilient supporting structure of chairs 1.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A resilient supporting structure of chairs, the resilient supporting structure comprising:

multiple resilient components arranged in parallel; each one of the resilient components comprising a resilient body; and two fixing elements; each of the two fixing elements mounted on a respective one of two ends of the resilient body; and multiple flexible supporting components interlaced with the resilient components at right angles, the flexible supporting components being non-extendable and non-compressible;

wherein two ends of each of the flexible supporting components surround two of the resilient components respectively, and are fixed to the flexible supporting components.

2. The resilient supporting structure of chairs as claimed in claim 1, wherein the flexible supporting components are flat belts.

3. The resilient supporting structure of chairs as claimed in claim 1, wherein the resilient body of each of the resilient components is a one-piece flat resilient belt, the flexible supporting components being flat belts.

4. The resilient supporting structure of chairs as claimed in claim 1, wherein the resilient body of each of the resilient components is a flat resilient belt which is formed by multiple resilient strips arranged in parallel and mounted together, the flexible supporting components being flat belts.

5. The resilient supporting structure of chairs as claimed in claim 1, wherein each of the two ends of each of the flexible supporting components is fixed by a sewing thread.

6. The resilient supporting structure of chairs as claimed in claim 3, wherein each of the two ends of each of the flexible supporting components is fixed by a sewing thread.

7. The resilient supporting structure of chairs as claimed in claim 4, wherein each of the two ends of each of the flexible supporting components is fixed by a sewing thread.

8. The resilient supporting structure of chairs as claimed in claim 1, wherein each of the two ends of each of the flexible supporting components is fixed by a riveting element.

9. The resilient supporting structure of chairs as claimed in claim 3, wherein each of the two ends of each of the flexible supporting components is fixed by a riveting element.

10. The resilient supporting structure of chairs as claimed in claim 4, wherein each of the two ends of each of the flexible supporting components is fixed by a riveting element.

11. The resilient supporting structure of chairs as claimed in claim 1, wherein each of the two ends of each of the flexible supporting components is fixed by a hook-and-loop fastener.

12. The resilient supporting structure of chairs as claimed in claim 3, wherein each of the two ends of each of the flexible supporting components is fixed by a hook-and-loop fastener.

13. The resilient supporting structure of chairs as claimed in claim 4, wherein each of the two ends of each of the flexible supporting components is fixed by a hook-and-loop fastener.

14. The resilient supporting structure of chairs as claimed in claim 1, wherein each of the two fixing elements comprises:

a connecting segment, a corresponding end of the resilient body being mounted in and connected to an end of the connecting segment; and a fixing segment formed on another end of the connecting segment and comprising at least one hole.

15. The resilient supporting structure of chairs as claimed in claim 6, wherein each of the two fixing elements comprises:

a connecting segment, a corresponding end of the resilient body being mounted in and connected to an end of the connecting segment; and a fixing segment formed on another end of the connecting segment and comprising at least one hole.

16. The resilient supporting structure of chairs as claimed in claim 7, wherein each of the two fixing elements comprises:

a connecting segment, a corresponding end of the resilient body being mounted in and connected to an end of the connecting segment; and a fixing segment formed on another end of the connecting segment and comprising at least one hole.

* * * * *